US007575539B2

(12) United States Patent
Kessler

(10) Patent No.: US 7,575,539 B2
(45) Date of Patent: Aug. 18, 2009

(54) UNIVERSAL EXERCISE APPARATUS

(76) Inventor: David Keith Kessler, 556 Grant Rd., Mineral Wells, TX (US) 76067

( * ) Notice: Subject to any disclaimer, the term of this patent is extended or adjusted under 35 U.S.C. 154(b) by 119 days.

(21) Appl. No.: 11/788,913

(22) Filed: Apr. 23, 2007

(65) Prior Publication Data

US 2007/0219072 A1 Sep. 20, 2007

Related U.S. Application Data

(63) Continuation-in-part of application No. 11/125,625, filed on May 10, 2005, now abandoned.

(51) Int. Cl.
*A63B 21/00* (2006.01)
*A63B 21/008* (2006.01)

(52) U.S. Cl. ..... 482/138; 482/112; 482/142

(58) Field of Classification Search ..... 482/56, 482/111–113, 138, 142
See application file for complete search history.

(56) References Cited

U.S. PATENT DOCUMENTS 1,990,124 A * 2/1935 Kabisius ..... 482/56
2,356,260 A * 8/1944 Maxwell ..... 482/129
2,497,391 A * 2/1950 Becker ..... 482/56
3,495,824 A * 2/1970 Cuinier ..... 482/113
3,759,512 A * 9/1973 Yount et al. ..... 482/62
4,226,415 A 10/1980 Wright
4,235,437 A * 11/1980 Ruis et al. ..... 482/5
4,429,871 A 2/1984 Flechner
4,572,500 A 2/1986 Weiss
4,602,780 A 7/1986 Gall
4,627,610 A 12/1986 Ishida et al.
4,629,185 A * 12/1986 Amann ..... 482/113
4,722,520 A 2/1988 Lee
4,750,735 A 6/1988 Furgerson et al.
4,763,897 A 8/1988 Yakata
4,813,667 A 3/1989 Watterson
4,872,668 A * 10/1989 McGillis et al. ..... 482/113
5,108,093 A 4/1992 Watterson
6,565,494 B1 * 5/2003 Chen ..... 482/124
6,645,130 B2 11/2003 Webber

FOREIGN PATENT DOCUMENTS

FR 2545724 A1 * 11/1984
FR 2701852 A1 * 9/1994
WO WO 9112854 A1 * 9/1991

* cited by examiner

*Primary Examiner*—Loan H Thanh
*Assistant Examiner*—Victor K Hwang
(74) *Attorney, Agent, or Firm*—Eric Karich

(57) ABSTRACT

An exercise apparatus has a table having a pair of opposed longitudinal edges, front and rear support elements for supporting the table above the ground, a pair of base elements, and a pair of exercise arms. Each of the pair of exercise arms is pivotally connected to a mounting point of one of the pair of base elements, and includes a vertical arm, a rotational connector rotatably connecting the vertical arm and the pivot element, a horizontal arm pivotally connected to the vertical arm, and a resistance device operably connected between the vertical and horizontal arms to provide resistance when the horizontal arm is moved with respect to the vertical arm.

2 Claims, 6 Drawing Sheets

UNIVERSAL EXERCISE APPARATUS

CROSS-REFERENCE TO RELATED APPLICATIONS

This application for a utility patent is a continuation-in-part of a previously filed utility patent, now abandoned, having the application Ser. No. 11/125,625, filed May 10, 2005.

STATEMENT REGARDING FEDERALLY SPONSORED RESEARCH

Not Applicable

BACKGROUND OF THE INVENTION

1. Field of the Invention

This invention relates generally to exercise machines, and more particularly to a exercise apparatus having a pair of exercise arms that each can pivot 180 degrees with respect to the table, and rotate 360 degrees, thereby enabling a broad range of exercises using a single, simple construction.

2. Description of Related Art

The prior art teaches various forms of exercise machines. However, the prior art does not teach an exercise apparatus having a pair of exercise arms that each can pivot with respect to the table, and rotate 360 degrees, thereby enabling a broad range of exercises using a single, simple construction. The present invention fulfills these needs and provides further related advantages as described in the following summary.

SUMMARY OF THE INVENTION

The present invention teaches certain benefits in construction and use which give rise to the objectives described below.

The present invention provides an exercise apparatus comprising a table having a pair of opposed longitudinal edges and a pair of opposed lateral edges, front and rear support elements for supporting the table above the ground, a pair of base elements each having a mounting point, and a pair of exercise arms. Each of the pair of exercise arms comprises a pivot element pivotally connected to the mounting point of one of the pair of base elements so that the exercise arm can pivot along the length of the longitudinal edge of the table, a vertical arm extending from the pivot element to beyond the longitudinal edge of the table, a rotational connector rotatably connecting the vertical arm and the pivot element so that the vertical arm can rotate with respect to the pivot element, a horizontal arm pivotally connected to the vertical arm, and a resistance device operably connected between the vertical and horizontal arms to provide resistance when the horizontal arm is moved with respect to the vertical arm.

A primary objective of the present invention is to provide an exercise apparatus having advantages not taught by the prior art.

Another objective is to provide an exercise apparatus having a pair of exercise arms that each can pivot 180 degrees with respect to the table, and rotate 360 degrees, thereby enabling a broad range of exercises using a single, simple construction.

Another objective is to provide an exercise apparatus that is simple and inexpensive to manufacture, and relatively lightweight for easy movement, storage and shipping.

A further objective is to provide an exercise apparatus that is easy for a user to use.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, an exercise apparatus 10 having a pair of exercise arms 40 that each can pivot, and rotate 360 degrees, thereby enabling a. broad range of exercises using a single, simple construction.

Figures 1, 2:
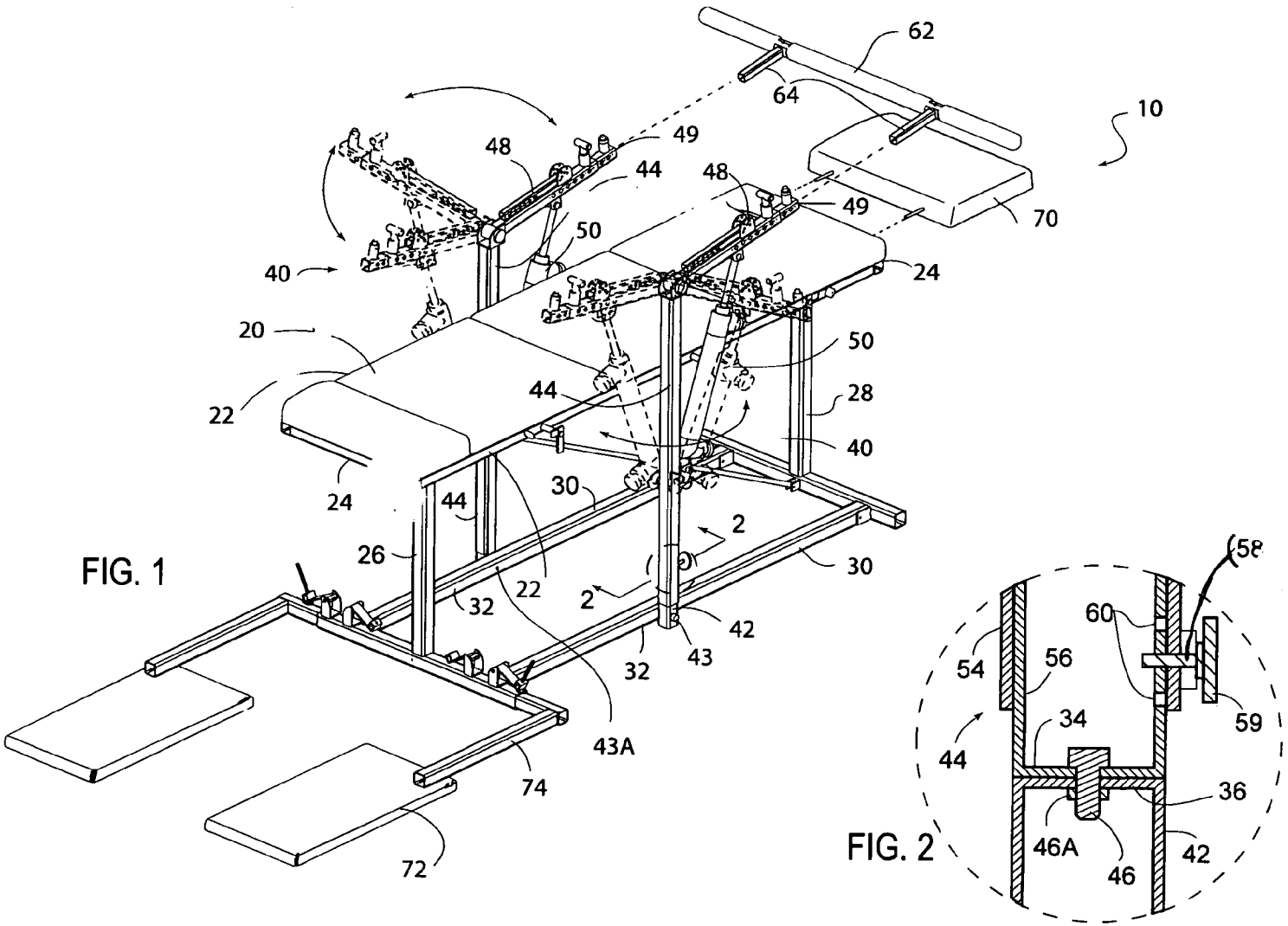
FIG. 1 is an exploded perspective view of a exercise apparatus according to a preferred embodiment of the present invention, illustrating the rotation of a pair of exercise arms with respect to a mounting point of a table of the exercise apparatus.
FIG. 2 is a sectional view of a portion of one of the exercise arms, taken along line 2-2 in FIG. 1.

FIG. 1 is an exploded perspective view of the exercise apparatus 10 according to a preferred embodiment of the present invention, illustrating the rotation of the pair of exercise arms 40 with respect to a mounting point 32 of a table 20 of the exercise apparatus 10. As shown in FIG. 1, the exercise apparatus 10 includes a table 20 having a pair of opposed longitudinal edges 22 and a pair of opposed lateral edges 24. The table 20 is preferably padded and generally rectangular in shape, although other shapes may also be used, including but not limited to curved edges and rounded or otherwise shaped ends. The terms "longitudinal edge 22" and "lateral edge 24" are hereby defined to be broadly construed to include the general outline of the table 20, and should not be construed to include only rectangular shapes, or in any other way limiting the construction of the table 20.

Front and rear support elements 26 and 28 extend downwardly from the table 20 for supporting the table 20 in a generally planar orientation above the ground. A pair of base elements 30 extend between the front and rear support elements 26 and 28, and each of the pair of base elements 30 has a mounting point 32 positioned beneath one of the pair of opposed longitudinal edges 22.

Critical to the invention, the exercise apparatus 10 further includes the pair of exercise arms 40 that are adapted to be used for performing a variety of exercises. Each of the pair of exercise arms 40 is preferably interchangeable in construction, so for simplicity we will only describe one exercise arm 40, with the understanding that the second exercise arm 40 is of similar construction.

The exercise arm 40 includes a pivot element 42 pivotally connected to the mounting point 32 of one of the pair of base elements 30 so that the exercise arm 40 can pivot with respect to the mounting point 32. The pivot element 42 is preferably connected to the mounting point 32 with a first bolt 43 that enables the vertical arm 44 to pivot 180 degrees with respect to the mounting point 32 of the base element 30 along the length of the longitudinal edge 22 of the table 20. The first bolt 43 may be secured with a first nut 43A, or a similar or equivalent structure. Those skilled in the art may devise alternative structure to provide the pivotal connection between the mounting point 32 and the pivot element 42, and such alternatives should be considered within the scope of the present invention.

As shown in FIG. 1, the exercise further includes a vertical arm 44 extending from the pivot element 42 to beyond the longitudinal edge 22 of the table 20, a horizontal arm 48 pivotally connected to the vertical arm 44, and a resistance device 50 operably connected between the vertical arm 44 and horizontal arm 48 to provide resistance when the horizontal arm 48 is moved with respect to the vertical arm 44. In the preferred embodiment, the hydraulic resistance device 50 is an adjustable two-way hydraulic cylinder that enables resistance exercises in moving the horizontal arm 48 in either direction with respect to the vertical arm 44.

Also illustrated in FIG. 1, the exercise apparatus 10 preferably further includes a crossbar 62 having a pair of connection points 64 adapted to be attached to a terminal end 49 of each of the horizontal arms 48. As described in greater detail below, the crossbar 62 enables various exercises using the pair of exercise arms 40.

In the embodiment of FIG. 1, the exercise apparatus 10 further includes an extension element 70 that can be attached to the table 20 for extending the length of the table 20. In this embodiment, the exercise apparatus 10 also includes a pair of foot rests 72 attached to the exercise apparatus 10 with extension bars 74. In use, as illustrated below, the user stands on the foot rests 72 for various exercises so that the exercise apparatus 10 remains firmly anchored to the ground.

FIG. 2 is a sectional view of a portion of one of the exercise arms 40, taken along line 2-2 in FIG. 1. As illustrated in FIG. 2, the vertical arm 44 preferably includes a top element 54 and a bottom element 56, the top element 54 and bottom element 56 are telescopically engaged for adjusting the overall length of the vertical arm 44. In the preferred embodiment, vertical arm 44 includes a locking pin 58 for engaging one of a plurality of apertures 60 for locking the position of the top element 54 with respect to the bottom element 56. For convenience of use, the locking pin 58 is preferably a spring-loaded pin that enables the quick and easy adjustment of the vertical arm 44 to suit the requirements of the user.

Also illustrated in FIG. 2, a rotational connector 46 rotatably connects the vertical arm 44 and the pivot clement 42 so that the vertical arm 44 can rotate with respect to the pivot element 42. In the preferred embodiment, the vertical arm 44 includes a top plate 34, and the pivot element 42 includes a bottom plate 36, and the rotational connector 46 is a second bolt 46 that rotatably connects the top and bottom plates 34 and 36 so that the vertical arm 44 can rotate 360 degrees with respect to the pivot element 42.

Figure 3:
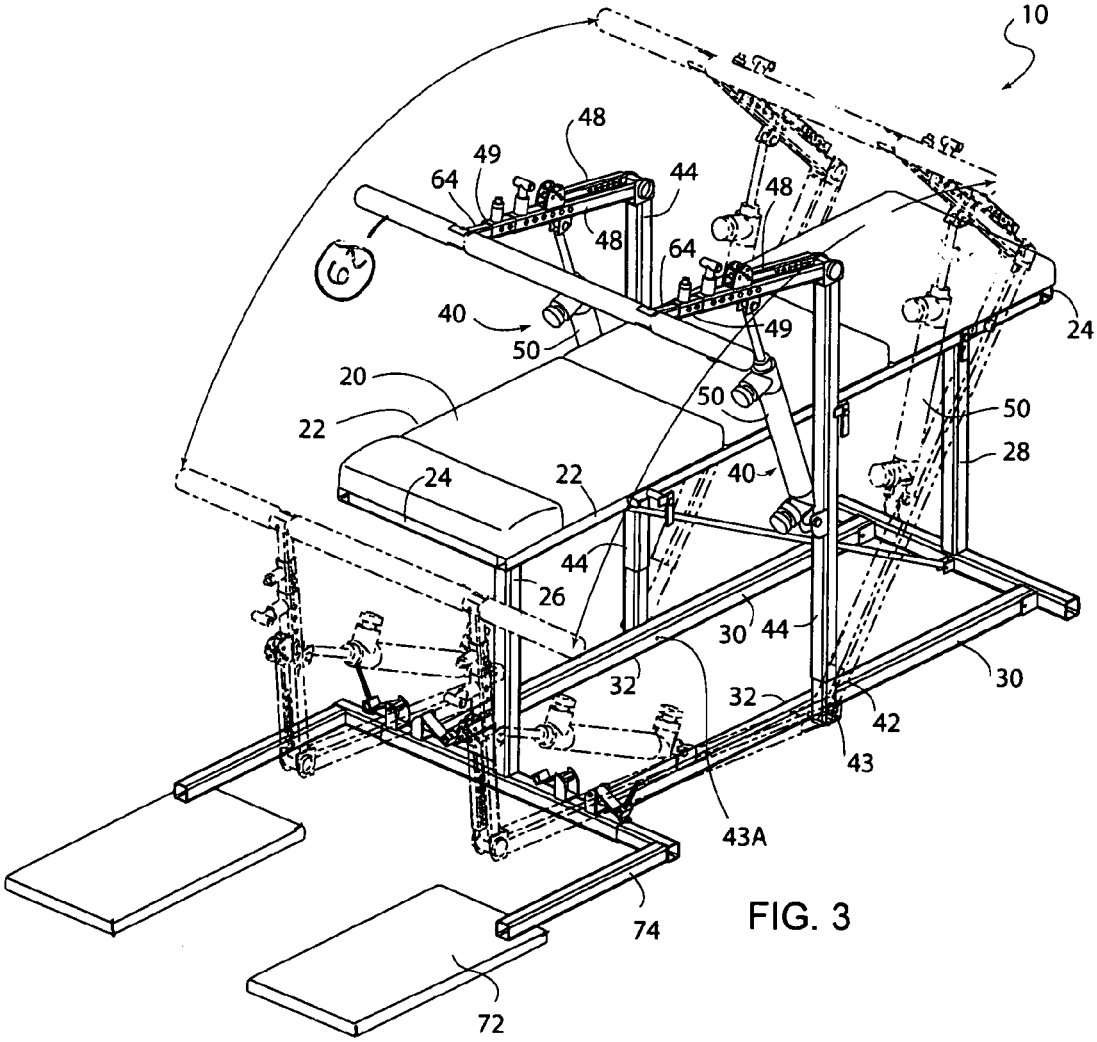
FIG. 3 is a perspective view of the exercise apparatus of FIG. 1, illustrating the pivotal movement of the pair of exercise bars.
Figure 4:
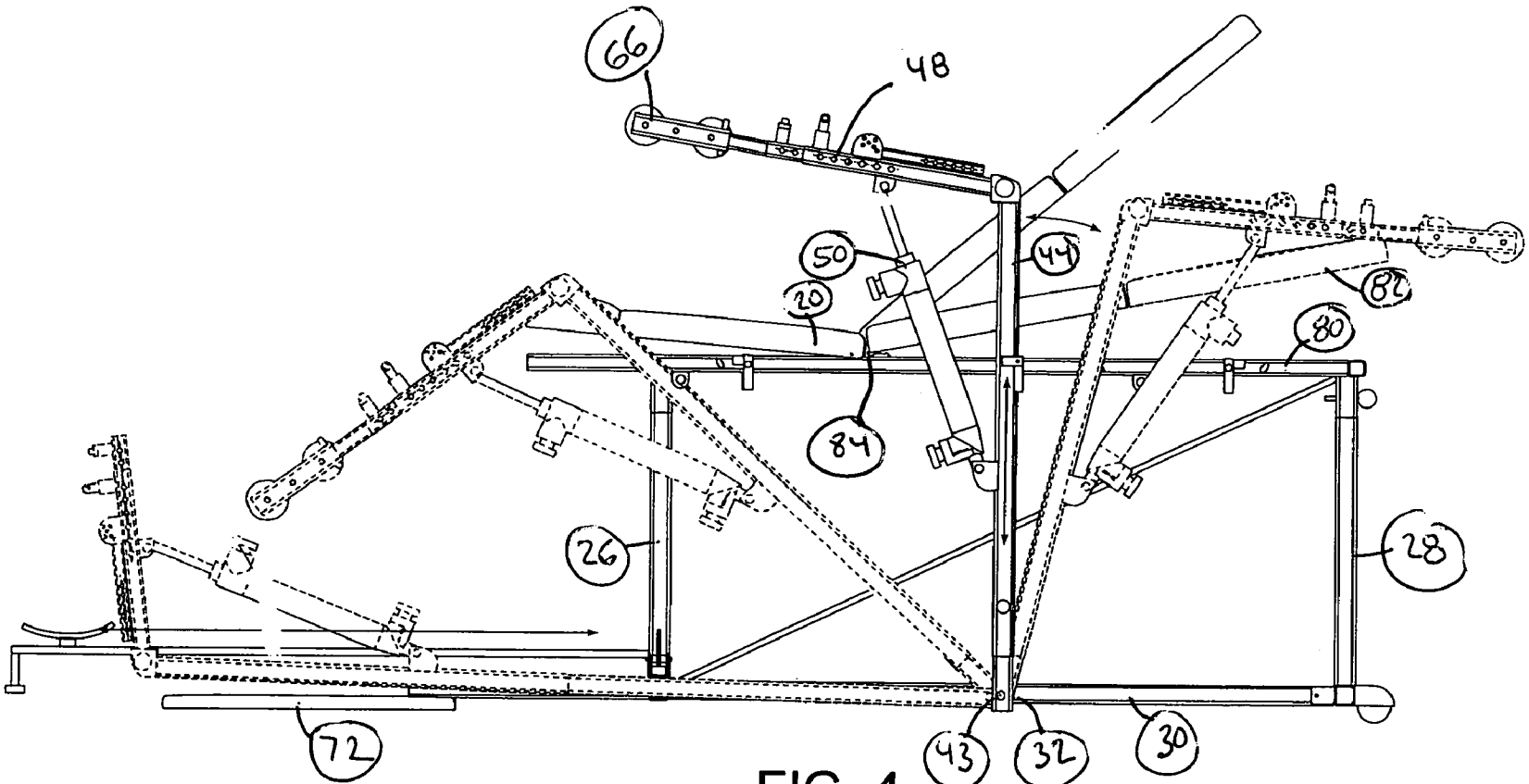
FIG. 4 is a side elevational view thereof.

FIG. 3 is a perspective view of the exercise apparatus 10 of FIG. 1, illustrating the pivotal movement of the pair of exercise bars. FIG. 4 is a side elevational view thereof as illustrated in FIGS. 3 and 4, each of the pair of exercise arms 40 pivots on one of the first bolts 43 (shown in FIG. 2) from positions that are generally perpendicular to the base elements 30 (and the ground), to positions that are generally parallel to the base elements 30 (and the ground), through 180 degrees of movement (although not all of the 180 degrees of potential movement are illustrated or necessarily needed). The different positions enable different forms of exercises.

Figure 5:
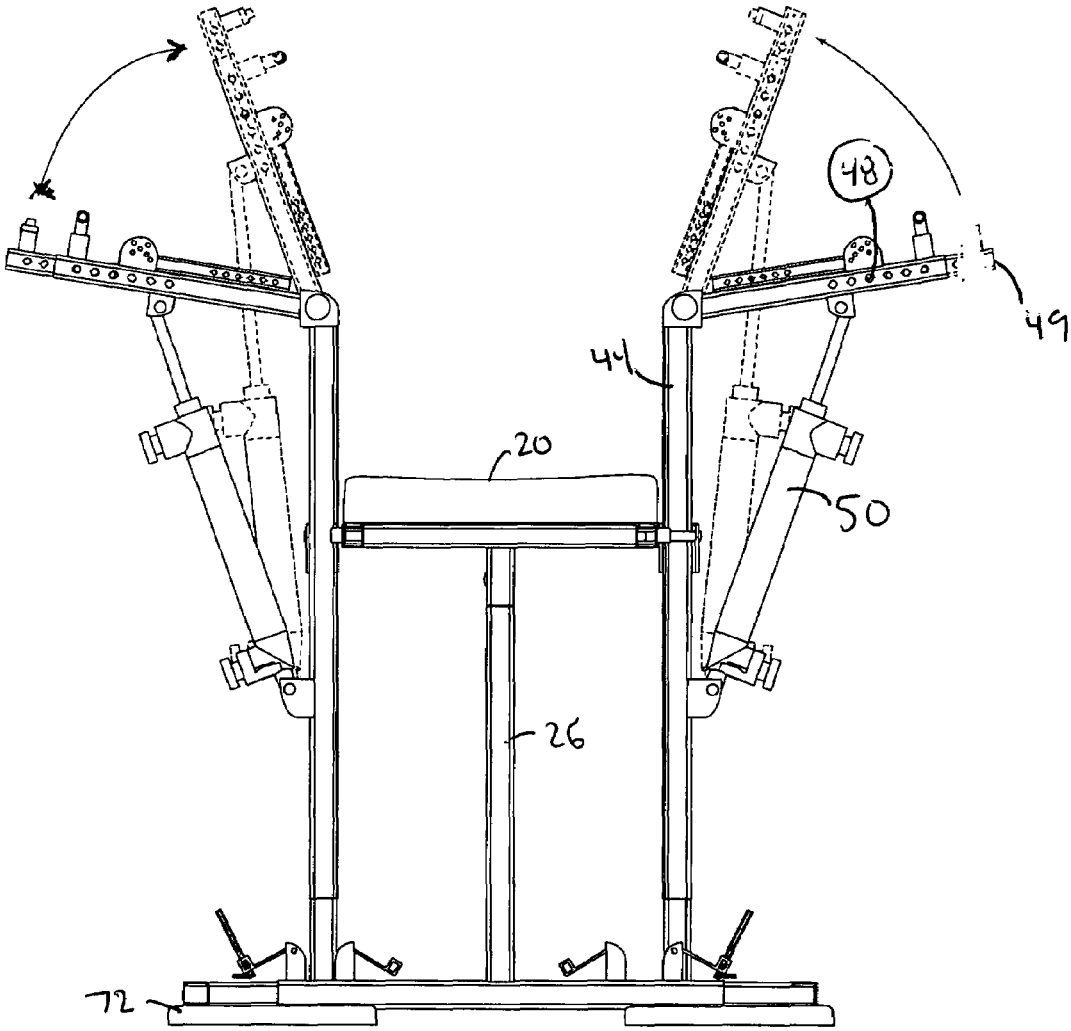
FIG. 5 is a front elevational view thereof, illustrating the movement of the horizontal arm with respect to the vertical arm during the use of the exercise apparatus.

FIG. 5 is a front elevational view of the exercise apparatus 10, illustrating the movement of the horizontal arm 48 with respect to the vertical arm 44 during the use of the exercise apparatus 10. As illustrated in FIG. 5, the horizontal arm 48 is pushed up (or pulled down in alternative exercises) against the resistance of the hydraulic cylinder. Further descriptions of various exercises enabled by the exercise apparatus 10 are described below, and illustrated in FIGS. 6-12.

Figure 6:
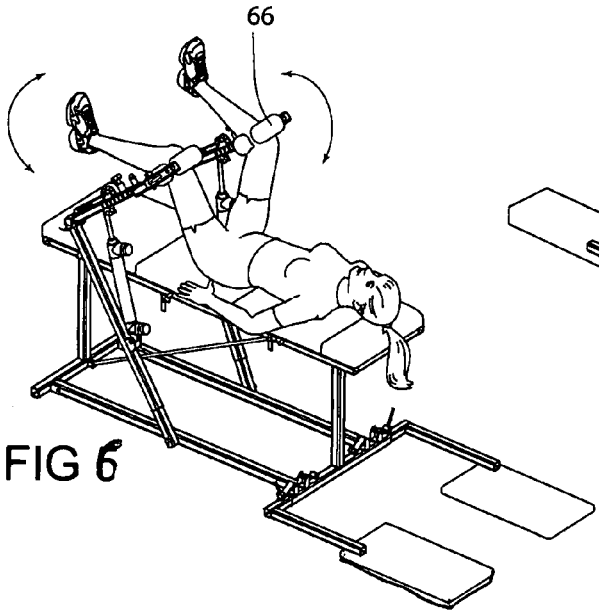
FIG. 6 is a perspective view of a user exercising her legs using the exercise apparatus, doing hip flexes and extensions.

FIG. 6 is a perspective view of a user exercising her legs using the exercise apparatus 10, doing hip flexes and extensions. In this embodiment, the vertical arms 44 are positioned between the perpendicular and parallel positions with respect to the base elements 30, and two pair of parallel rollers 66 are attached to a terminal end 49 of each one of the horizontal arms 48. Each of the pair of parallel rollers 66 are preferably padded, and generally similar in construction to leg-engaging elements of prior art exercise devices.

Figure 7:
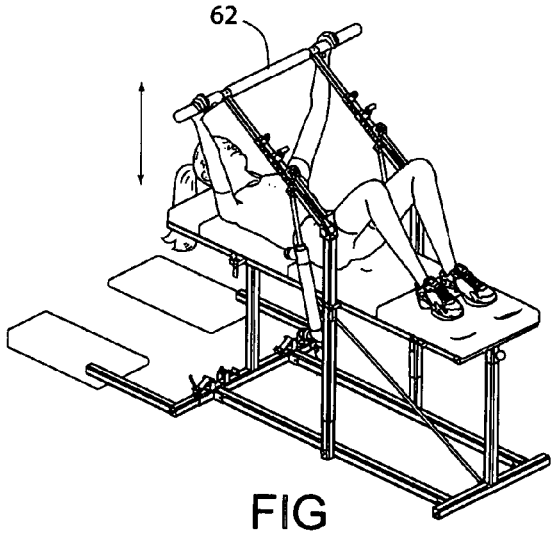
FIG. 7 is a perspective view of the user using the exercise apparatus as a bench press.

FIG. 7 is a perspective view of the user using the exercise apparatus 10 as a bench press. In this embodiment, the vertical arms 44 are positioned perpendicular to the base elements 30, and the user can press up against the crossbar 62 against the resistance of the pneumatic cylinders.

Figure 8:
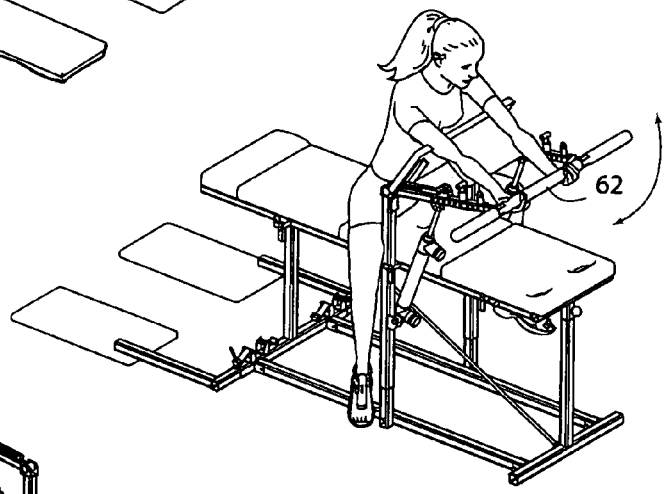
FIG. 8 is a perspective view of the user doing curls using the exercise apparatus.
Figure 9:
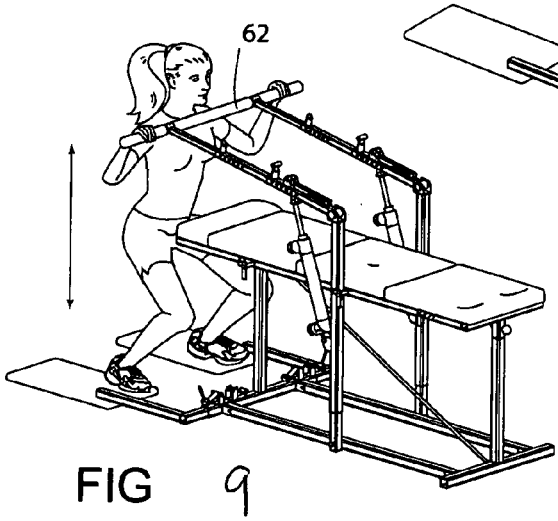
FIG. 9 is a perspective view of the user doing squats using the exercise apparatus.
Figure 10:
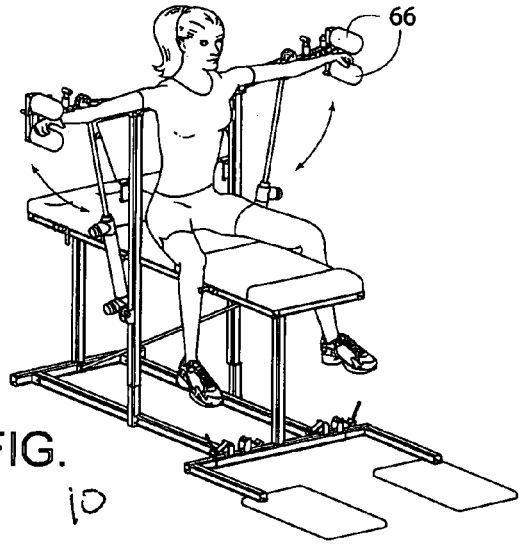
FIG. 10 is a perspective view of the user doing arm lifts using the exercise apparatus.

Many alternative exercises are also enabled using the exercise apparatus 10. FIG. 8 is a perspective view of the user doing curls using the exercise apparatus 10. FIG. 9 is a perspective view of the user doing squats using the exercise apparatus 10. FIG. 10 is a perspective view of the user doing arm lifts using the exercise apparatus 10.

Figure 11:
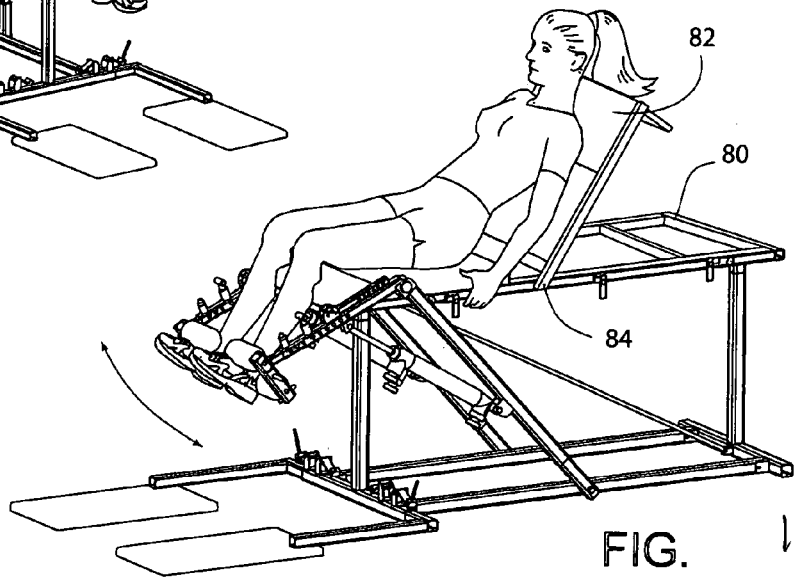
FIG. 11 is a perspective view of the exercise apparatus illustrating the table in an inclined configuration so that the user can perform leg extension exercises.

FIG. 11 is a perspective view of the exercise apparatus 10 illustrating the table 20 in an inclined configuration so that the user can perform leg extension exercises. As illustrated in this embodiment, the table 20 preferably includes a frame 80 and a padded top 82. The padded top 82 is attached to the exercise apparatus 10 with a pivot 84 and can be raised from a generally horizontal position to the inclined configuration for facilitating additional exercises, such as the leg extension exercises illustrated.

Figure 12:
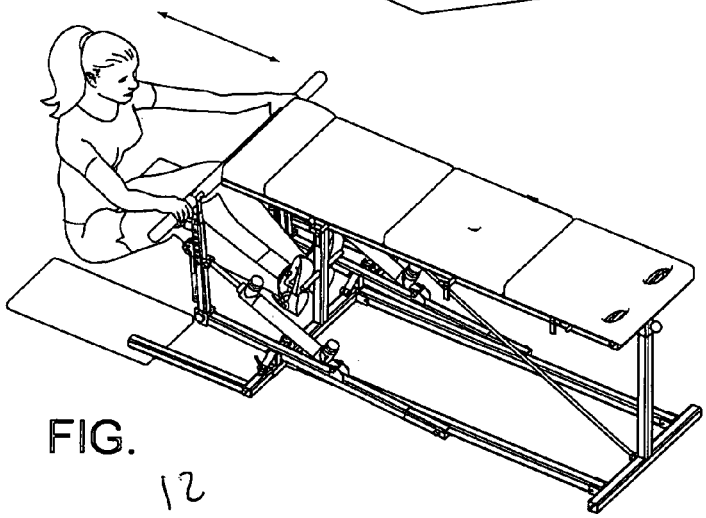
FIG. 12 is a perspective view of the user using the exercise apparatus as a rowing machine.

FIG. 12 is a perspective view of the user using the exercise apparatus 10 as a rowing machine. While various exercises are specifically illustrated herein, the function of the exercise apparatus 10 should not be construed to be limited to these particular exercises, but should be construed to include alternative exercises consistent with the description of the present invention.

The terminology used in the specification provided above is hereby defined to include similar and/or equivalent terms, and/or alternative embodiments that would be considered obvious to one skilled in the art given the teachings of the present patent application. The terms "horizontal" and "vertical" are for convenience only, and are not limited to particular orientations. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An exercise apparatus comprising:

a table having a pair of opposed longitudinal edges;

front and rear support elements for supporting the table;

a pair of base elements extending between the front and rear support elements, each of the pair of base elements having a mounting point positioned beneath one of the pair of opposed longitudinal edges;

a pair of exercise arms, each of the pair of exercise arms comprising:

a pivot element pivotally connected to the mounting point of one of the pair of base elements so that the exercise arm can pivot with respect to the mounting point;

a vertical arm extending from the pivot element to beyond the longitudinal edge of the table;

a rotational connector rotatably connecting the vertical arm and the pivot element so that the vertical arm can rotate with respect to the pivot element;

a horizontal arm pivotally connected to the vertical arm; and a resistance device operably connected between the vertical and horizontal arms to provide resistance when the horizontal arm is moved with respect to the vertical arm; and a crossbar having a pair of connection points adapted to be attached to a terminal end of the horizontal arms.

2. An exercise apparatus comprising:

a table having a pair of opposed longitudinal edges;

front and rear support elements for supporting the table;

a pair of base elements extending between the front and rear support elements, each of the pair of base elements having a mounting point positioned beneath one of the pair of opposed longitudinal edges;

a pair of exercise arms, each of the pair of exercise arms comprising:

a pivot element pivotally connected to the mounting point of one of the pair of base elements so that the exercise arm can pivot with respect to the mourning point;

a vertical arm extending from the pivot element to beyond the longitudinal edge of the table;

a rotational connector rotatably connecting the vertical arm and the pivot element so that the vertical arm can rotate with respect to the pivot element;

a horizontal arm pivotally connected to the vertical arm; and a resistance device operably connected between the vertical and horizontal arms to provide resistance when the horizontal arm is moved with respect to the vertical arm; and a pair parallel rollers adapted to be attached to a terminal end of one of the horizontal arms.

* * * * *